US006154620A

United States Patent [19]

Hagiwara

[11] Patent Number: 6,154,620

[45] Date of Patent: Nov. 28, 2000

[54] TONER CONCENTRATION MEASURING METHOD, TONER CONCENTRATION MEASURING APPARATUS AND IMAGE FORMING APPARATUS EMPLOYING THE SAME

[75] Inventor: Yoshihiro Hagiwara, Niigata, Japan

[73] Assignee: NEC Corporation, Tokyo, Japan

[21] Appl. No.: 09/426,344

[22] Filed: Oct. 25, 1999

[30] Foreign Application Priority Data

Oct. 27, 1998 [JP] Japan ..... 10-305724

[51] Int. Cl.[7] ..... G03G 15/10

[52] U.S. Cl. ..... 399/57; 399/61

[58] Field of Search ..... 399/30, 57, 58, 399/61, 62; 73/53.01; 324/71.1

[56] References Cited

U.S. PATENT DOCUMENTS 4,257,347 3/1981 Stahl ..... 399/57 X
5,848,322 12/1998 Chen et al. ..... 399/57
5,995,778 11/1999 Yamaguchi ..... 399/61

FOREIGN PATENT DOCUMENTS 2-169259 6/1990 Japan .
6-241996 9/1994 Japan .

*Primary Examiner*—Sophia S. Chen
*Attorney, Agent, or Firm*—Ostrolenk, Faber, Gerb & Soffen, LLP

[57] ABSTRACT

A toner concentration measuring method and apparatus by which the concentration of toner in solvent can be detected accurately with a simple construction without being influenced by a variation of the conductivity caused by a variation of the amount of ions in the solvent. A stepped dc voltage is applied from a high dc voltage generation section between a pair of electrodes placed in solvent, and very weak current which flows in a circuit formed from the pair of electrodes is measured by a current measuring section. The solvent between the pair of electrodes is replaced into an equivalent circuit, and a capacitance of the equivalent circuit is calculated in accordance with a circuit equation to determine the amount of ions in the solvent. Further, in accordance with a function expression wherein the ion amount and a resistance of the equivalent circuit are used as parameters, a toner concentration from which an influence of a variation of the amount of ions in the solvent is eliminated is determined.

7 Claims, 5 Drawing Sheets

TONER CONCENTRATION MEASURING METHOD, TONER CONCENTRATION MEASURING APPARATUS AND IMAGE FORMING APPARATUS EMPLOYING THE SAME

BACKGROUND OF THE INVENTION

1. Field of the Invention

The present invention relates to a toner concentration measuring method, a toner concentration measuring apparatus and an image forming apparatus employing the same, and a toner concentration measuring method and a toner image measuring instrument by which the concentration of toner in solvent is detected and an image forming apparatus employing the same.

2. Description of the Related Art

Conventionally, a remaining ink amount detecting apparatus for liquid development is required only to detect presence or absence of ink and represent it in a binary value. Thus, a method wherein a voltage is applied to an electrode pair to measure a capacitance between the electrodes is disclosed, for example, in Japanese Patent Laid-Open No. Hei 2-169259. Also another method wherein an amount of transmission light is measured using a light emitting diode and a light receiving element is disclosed, for example, in Japanese Patent Laid-Open No. Hei 6-241996.

However, the conventional methods described above cannot be used to measure the concentration of toner in solvent. Also a method of measuring the concentration of toner in solvent is conventionally known. According to the conventional method, for example, a light emitting diode is used to read an analog variation of the amount of transmission light, and an ac voltage is applied to an electrode pair placed in solvent to measure the concentration of toner from a variation value of the capacitance between the electrodes.

The conventional method just described has a problem of an accuracy of measurement. Where light is used to measure the concentration, the light is attenuated significantly while it passes through the solvent. Consequently, a light emitting element having a very large amount of light emission must be used. However, the amount of light which can be received by the light receiving element is still small, and consequently, the accuracy in measurement of the concentration based on the received mount of light is low. Further, if the light emitting element or the light receiving element is placed in the solvent, the light emitting face or the light receiving face must be kept clean, or if the light emitting element or the light receiving element is located outside a member in which the solvent is accommodated, then a light transmitting wall of the member must be kept clean. If a light transmitting portion becomes soiled, then the accuracy in measurement is further deteriorated.

The conventional method has another problem in that a conventional technique for electric measurement cannot be applied as it is. This is because, even though the conductivity or the capacitance of the solvent can be measured, it is impossible to extract only the concentration of the toner from the measured conductivity or capacitance.

SUMMARY OF THE INVENTION

It is an object of the present invention to provide a toner concentration measuring method and a toner concentration measuring apparatus by which the concentration of toner in solvent can be detected accurately with a simple construction without being influenced by a variation of the conductivity caused by a variation of the amount of ions in the solvent and an image forming apparatus which employs the toner concentration measuring apparatus.

In order to attain the object described above, according to an aspect of the present invention, there is provided a toner concentration measuring method for measuring the concentration of toner in solvent, comprising the steps of applying a stepped dc voltage between a pair of electrodes in the solvent, measuring very weak current flowing in a circuit formed from the pair of electrodes, calculating, with the solvent between the pair of electrodes replaced into an equivalent circuit, a capacitance of the equivalent circuit in accordance with a circuit equation to determine the amount of ions in the solvent, and determining a toner concentration, from which an influence of a variation of the amount of ions in the solvent is eliminated, in accordance with a function expression in which the amount of ions and an impedance of the equivalent circuit are included as parameters.

According to another aspect of the present invention, there is provided a toner concentration measuring apparatus for measuring the concentration of toner insolvent, comprising, a pair of electrodes placed in the solvent, voltage application means for applying a stepped dc voltage between the pair of electrodes, current measurement means for measuring very weak current flowing in a circuit formed between the pair of electrodes, ion amount calculation means for calculating, with the solvent between the pair of electrodes replaced into an equivalent circuit, a capacitance of the equivalent circuit in accordance with a circuit equation to determine the amount of ions in the solvent, and concentration calculation means for determining a toner concentration, from which an influence of a variation of the amount of ions in the solvent is eliminated, in accordance with a function expression in which the amount of ions and an impedance of the equivalent circuit are included as parameters.

Preferably, the pair of electrodes are cylindrical electrodes extending in parallel to each other such that circumferential faces thereof are opposed to and located near to each other, and are rotated by power from the outside so that, when rotated, the circumferential surfaces thereof are cleaned by a cleaning member secured in the apparatus.

The equivalent circuit can be determined in the following manner.

It is assumed that the output current $I_{total}$ measured when the stepped dc voltage is applied to the solvent is composed of an output $I_{toner}$ originating from particles of the toner which have masses and originating from back plating of the particles of the toner and another output $I_{ion}$ originating from ions having little masses and originating from back plating of positive and negative ions such that an expression $I_{total}=I_{toner}+I_{ion}$ may be satisfied; the output value $I_{ion}$ which originates from the positive and negative ions is assumed as an output of an $R_1C_1$ circuit of a resistance $R_1$ and a capacitance $C_1$ and represented by an attenuation function $I_{ion}=(V/R_1)\exp(-t/C_1R_1))$ where V is a voltage and t is time; also the output $I_{toner}$ originating from the toner is assumed as an output of an $R_2C_2$ circuit of an impedance $R_2$ and a capacitance $C_2$ while oscillations of the output which are caused by the inertia of toner particles are considered to be a behavior of a second-order lag system, and the output $I_{toner}$ originating the toner is modeled with an $R_3C_3L_3$ circuit of a resistance $R_3$, a capacitance $C_3$ and an inductance $L_3$ to calculate the output $I_{toner}$ originating from the toner as a sum of an attenuation function $I_{att}$ and an attenuation oscillation function $I_{osc}$ in accordance with $$I_{toner}=I_{att}+I_{osc}$$

$$I_{toner-att}=(V/R_2)exp(-t/(C_2R_2))$$

$$I_{toner-osc}=((\alpha^2+\omega^2)/\omega)C_3exp(-\alpha t)\cos(\omega t)$$

where $\alpha=R_3/(2L_3)$, $\omega=(1/(L_{3C3})-\alpha^2)^{1/2}$then, the output current value $I_{total}$ flowing in the equivalent circuit is represented by $$I_{total}=I_{ion}+I_{toner-att}+I_{toner-osc}=(V/R_1)exp(-t/C_1R_1))+(V/R_2)exp(-t/(C_2R_2))+((\alpha^2+\omega^2)/\omega)C_3exp(-\alpha t)\cos(\omega t)$$

and then, the output current value $I_{total}$ is regarded as output current of the equivalent circuit composed of the $R_1C_1$ series circuit, the $R_2C_2$ series circuit and the $R_3C_3L_3$ series circuit connected in parallel.

Alternatively, it is assumed that the capacitance component is uniform for simplified consideration of the equivalent circuit and consequently only one capacitance component is involved as represented by $C_1 \equiv C_2 \equiv C_3 \equiv C$, and the resistances $R_1$ and $R_2$ are composed and other variables are re-arranged to place $$R_{att}=1/(1/R_1+1/R_2)$$

$$I_{att}=I_{ion}+I_{toner-att}$$

$$R_{osc}=R_3$$

$$I_{osc}=I_{toner-osc}$$

$$L_{osc}=L_3$$

and then, the composed circuit is determined as the equivalent circuit including the $R_{osc}L_{osc}$ series circuit and the resistance $R_{att}$ are connected in parallel.

In this instance, the current amount $I_{total}$ which flows through the circuit when the switch of the equivalent circuit is closed is represented by $$I_{total}=((\alpha^2+\omega^2)/\omega)CVexp(-\alpha t)\cos(\omega t)+(V/R_{att})exp(-t/CR_{att})$$

where $\alpha=R_{osc}/(2L_{osc})$ and $\omega=(1/(L_{osc}C)-\alpha^2)-\alpha^2)^{1/2}$, and the behavior I of toner particles and ions in the solvent is defined as represented by $$I=P_1(-P_2t)\cos(P_3t)+P_4exp(-P_5t)$$

where $$P_1=1/(L_{osc}/C-(R_{osc}/2)^2)^{1/2}$$

$$P_2=(R_{osc}/(2L_{osc}))$$

$$P_3=(1/(L_{osc}C)+R_{osc}/(2L_{osc}))^2)^{1/2}$$

$$P_4=V/R_{osc}$$

$$P_5=1/(R_{att}C)$$

and, from the expression above, the RCL components of the equivalent circuit is determined as $$C=P_4/(P_5V)$$

$$L_{osc}=1/(C(P_22+P_32)$$

$$R_{osc}=2L_{osc}P_2$$

$$R_{att}=V/P_4$$

and then, toner concentration information $F_1(\ )$ is determined in accordance with a function expression represented by $F_1(\ )=R_{att}C^K$, where K is a coefficient which depends upon the temperature, the viscosity of the solvent used or the amount of charge of the toner.

The toner concentration measuring method and apparatus is advantageous in that the toner concentration can normally be measured accurately. The reason is that, while an electric concentration sensor cannot normally perform accurate concentration measurement in a process in which charge is exchanged frequently as in an electrophotographic printer because the electric concentration sensor is normally influenced by ions in the solvent, the toner concentration measuring method and apparatus is not influenced by ions in the solvent.

The toner concentration measuring method and apparatus is advantageous also in that concentration measurement can be realized with a simple structure. The reason is that, while, where an electric concentration sensor is employed, in order to measure the amount of ions, it is necessary to correct a result of detection of the electric concentration sensor using a separate conductivity sensor because the electric concentration sensor is normally influenced by ions in the solvent as described above, the toner concentration measuring method and apparatus is not influenced by ions in the solvent.

The above and other objects, features and advantages of the present invention will become apparent from the following description and the appended claims, taken in conjunction with the accompanying drawings in which like parts or elements are denoted by like reference symbols.

DESCRIPTION OF THE PREFERRED EMBODIMENT

Figure 1:
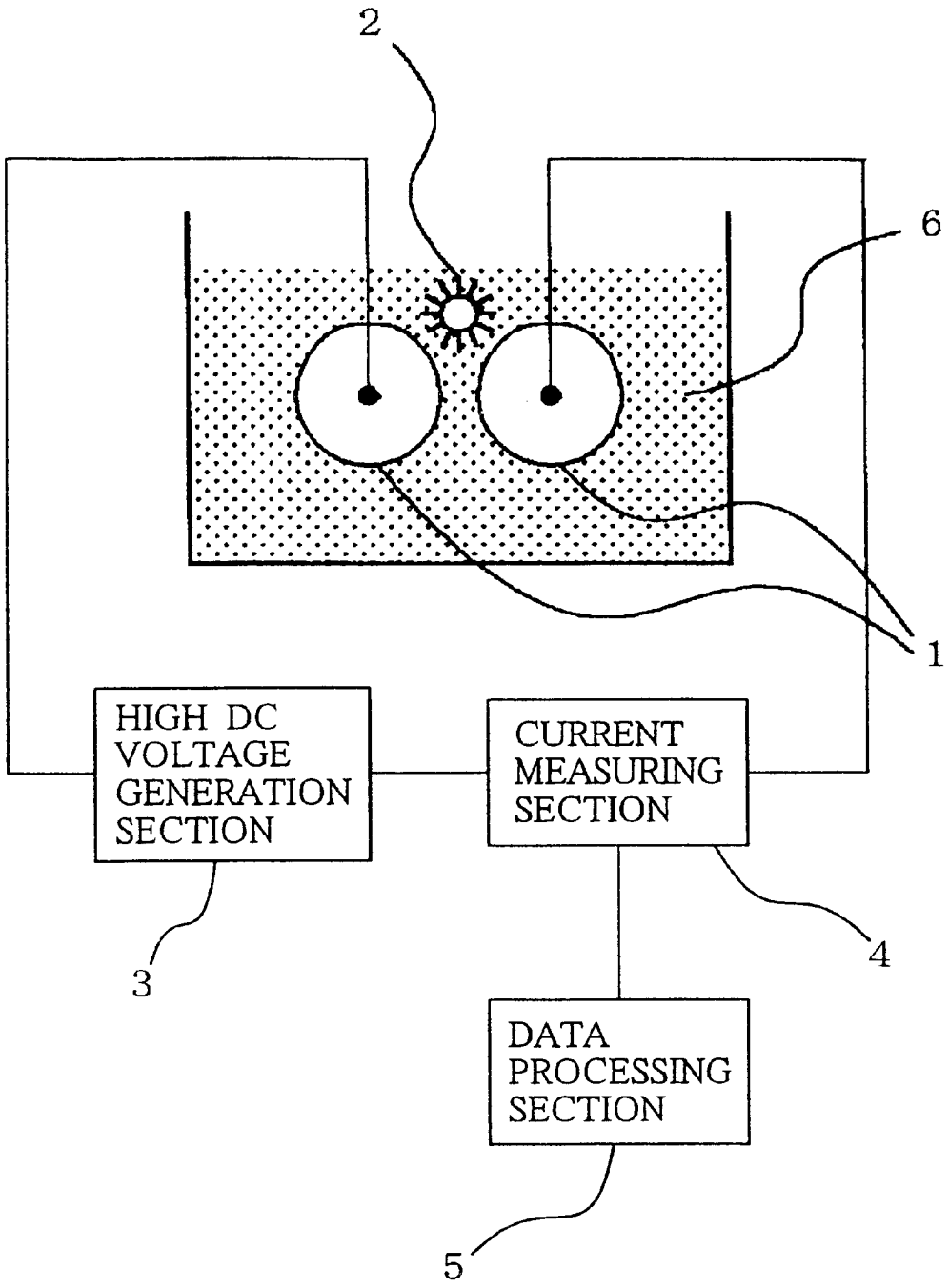
FIG. 1 is a schematic diagrammatic view showing a toner concentration measuring apparatus to which the present invention is applied.

Referring to FIG. 1, there is shown a toner concentration measuring apparatus to which the present invention is applied. The toner concentration measuring apparatus shown includes an electrode pair 1 placed in solvent 6, a cleaning member 2 for cleaning the electrode pair 1, a high dc voltage generation section 3 for applying a stepped high dc voltage to the electrode pair 1, a current measuring section 4 for measuring current of a circuit formed between the electrodes of the electrode pair 1, and a data processing section 5 for processing measurement data.

The electrode pair 1 includes a pair of cylindrical electrodes extending in parallel to each other such that circumferential faces thereof are positioned in an opposing and neighboring relationship to each other. The electrodes of the electrode pair 1 are rotated by power transmitted thereto from the outside such that, before and after measurement of the concentration, the surfaces thereof are cleaned by the cleaning member 2 secured in the apparatus when the electrodes of the electrode pair 1 are rotated. The high dc voltage generation section 3 has a function of generating a stepped electric field of 2 MV/m to 4 MV/m between the electrodes of the electrode pair 1. The current measuring section 4 has, for example, a sampling frequency of 1 kHz or more and a resolution of 8 bits or more.

Figure 2:
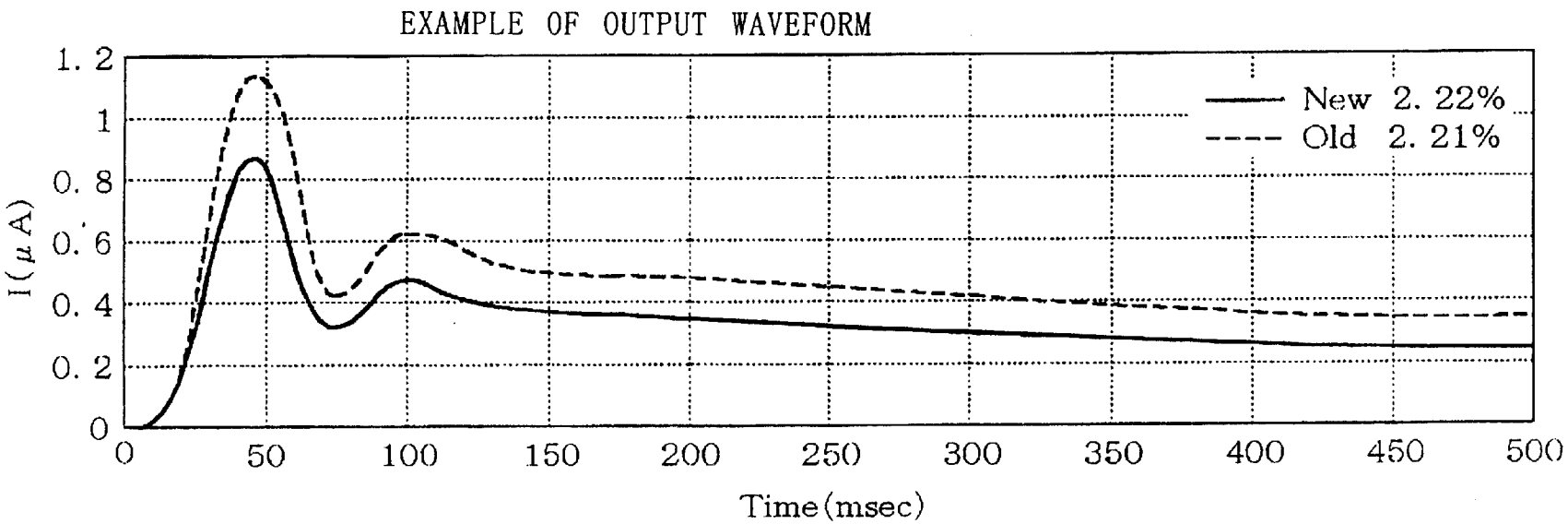
FIG. 2 is a waveform diagram showing an example of a waveform measured by a current measuring section of the toner concentration measuring apparatus of FIG. 1.

FIG. 2 shows an example of a waveform measured by the current measuring section 4. Operation of the toner concentration measuring apparatus of the present embodiment is described with reference to FIGS. 1 and 2.

A stepped high dc voltage generated by the high dc voltage generation section 3 is applied between the electrodes of the electrode pair 1. Thereupon, a strong electric field of approximately 2 MV/m to 4 MV/m is generated momentarily in the proximity of and between the electrodes of the electrode pair 1. By the strong electric field, toner particles in the solvent are charged and begin to migrate toward the polarities opposite to the polarities of the toner particles themselves. Also positive and negative ions in the solvent similarly move in the directions toward the polarities opposite to the polarities of the ions themselves. If the ions arrive at the surfaces of the electrode pair 1, then they lose their charge, and toner particles are polarized and stick to the surfaces of the electrode pair 1. Consequently, very weak current flows in the circuit formed between the electrodes of the electrode pair 1. Since the toner particles sticking to the surfaces of the electrode pair 1 lower the absolute values of the potentials on the surfaces of the electrode pair 1, after the high voltage is applied, the current value which first exhibits a peak value decreases gradually and finally to zero.

Since the current value measured in this instance varies depending upon the amount of ions and the concentration of the toner in the solvent, if the amount of ions has little variation, then the magnitude of the measured current value represents information of the toner concentration. However, this is impossible in an environment wherein ions are added or removed in the process of development. In the environment described, an output value which only depends upon the toner concentration must be extracted from the measurement value.

Thus, the phenomenon described above is modeled into an electric equivalent circuit, and output current of the electric equivalent circuit is defined with a mathematical expression. When a stepped voltage is applied to the solvent 6, output current measured by the current measuring section 4 attenuates while oscillating as seen in FIG. 2. It is estimated that such oscillations arise from some lag in electric migration of toner particles in the solvent 6 caused by inertial forces of them because they themselves have masses. Therefore, the output current $I_{total}$ measured as a total value is decomposed into an output $I_{toner}$ originating from toner particles having masses (an output based on back plating of toner particles) and another output $I_{ion}$ originating from ions having little masses (an output based on back plating of positive and negative ions) as given by the following expression (1):

$$I_{total}=I_{toner}+I_{ion} \tag{1}$$

Of the components, the output value $I_{ion}$ originating from positive and negative ions can be regarded an output of an RC circuit composed of a resistance (R) and a capacitance (C) and can be represented by such an attenuation function as given by the following expression (2):

$$I_{ion}=(V/R_1)exp(-t/C_1R_1)) \tag{2}$$

Meanwhile, as regards the output $I_{toner}$ originating from the toner, oscillations of the output which are caused by the inertia of toner particles are considered to be a behavior of a second-order lag system of a circuit having a resistance (R) and a capacitance (C) similarly as described above. Thus, the output $I_{toner}$ originating the toner is modeled with an RCL circuit including an inductance (L) in addition to the resistance (R) and the capacitance (C) and can thus be represented as a sum of an attenuation function $I_{att}$ and an attenuation oscillation function $I_{osc}$ as given in the following expression (3):

$$I_{toner}=I_{att}+I_{osc} \tag{3}$$

$$I_{toner-att}=(V/R_2)exp(-t/(C_2R_2)) \tag{4}$$

$$I_{toner-osc}=((\alpha^2+\omega^2)/\omega)C_3exp(-\alpha t)\cos(\omega t) \tag{5}$$

where $$\alpha=R_3/(2L_3),\ \omega=(1/(L_3C_3)-\alpha^2)^{1/2}$$

Consequently, the output current value $I_{total}$ flowing in the equivalent circuit can be represented by the following expression (6):

$$I_{total}=I_{ion}+I_{toner-att}+I_{toner-osc}=(V/R_1)exp(-t/C_1R_1))+(V/R_2)exp(-t/(C_2R_2))+((\alpha^2+\omega^2)/\omega)C_3exp(-\alpha t)\cos(\omega t) \tag{6}$$

Figure 3:
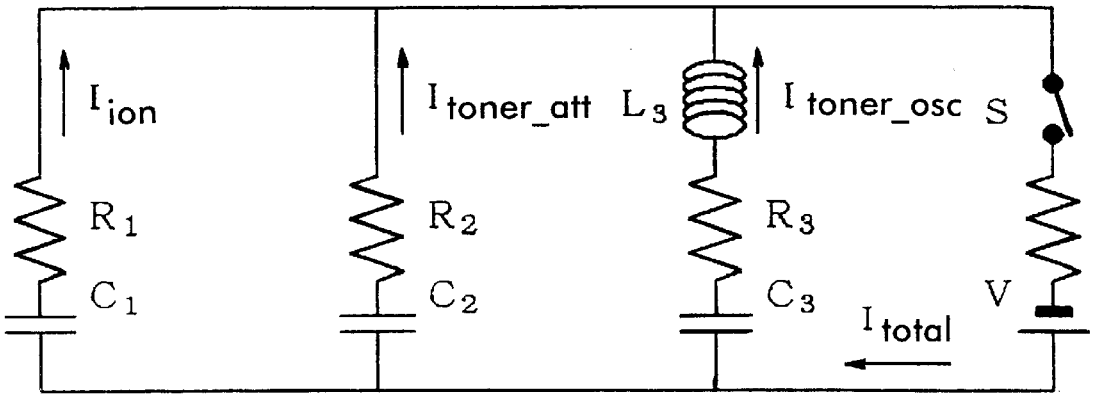
FIG. 3 is a circuit diagram showing an equivalent circuit to the toner concentration measuring apparatus of FIG. 1.

This can be represented in such a circuit diagram as shown in FIG. 3 which includes a switch S. Here, although it is estimated that the capacitance component (C) in actual ink has a distribution due to some local presence of toner particles and/or ions in the fluid and so forth, it is assumed that the capacitance component is uniform for simplified consideration on the equivalent circuit. Further, since timings at which the electrodes actually become saturated by toner particles and ions sticking thereto are equal, it is assumed that only one capacitance component is involved. Consequently, $$C_1\equiv C_2\equiv C_3\equiv C \tag{7}$$

Further, in order to simplify the circuit configuration, the resistances $R_1$ and $R_2$ are composed and other variables are re-arranged to place $$R_{att}=1/(1/R_1+1/R_2) \tag{8}$$

$$I_{att}=I_{ion}+I_{toner-att}$$

$$R_{osc}=R_3$$

$$I_{osc}=I_{toner-osc}$$

$$L_{osc}=L_3$$

Figure 4:
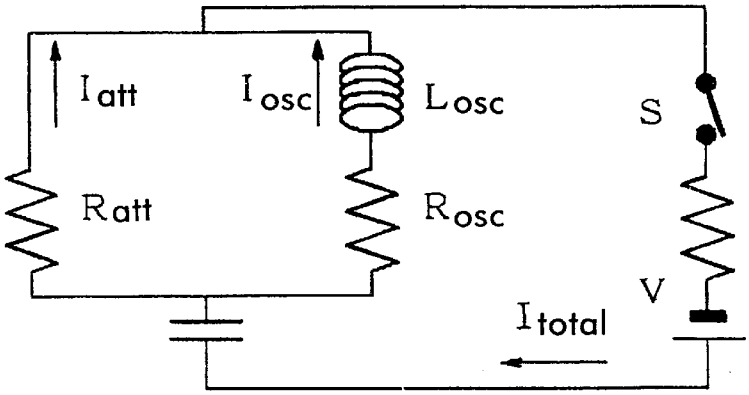
FIG. 4 is a circuit diagram of a simplified form of the equivalent circuit shown in FIG. 3.

Thus, the composed circuit has such a configuration as shown in FIG. 4. The current amount $I_{total}$ which flows through the circuit when the switch S of the circuit is closed is represented by the following expression (9):

$$I_{total}=((\alpha^2+\omega^2)/\omega)CVexp(-\alpha t)\cos(\omega t)+(V/R_{att})exp(-t/CR_{att}) \quad (9)$$

where $$\alpha=R_{osc}/(2L_{osc}) \text{ and } \omega=(1/(L_{osc}C)-\alpha^2)^{1/2}.$$

From the foregoing, in the present specification, the behavior I of toner particles and ions in the insulating solvent is defined as given by the following expression (10):

$$I=P_1(-P_2t)\cos(P_3t)+P_4exp(-P_5t) \quad (10)$$

where $$P_1-1/(L_{osc}/C-(R_{osc}/2)^2)^{1/2}$$

$$P_2=(R_{osc}/(2L_{osc}))$$

$$P_3=(1/(L_{osc}C)+R_{osc}/(2L_{osc}))^2)^{1/2}$$

$$P_4=V/R_{osc}$$

$$P_5=1/(R_{att}C)$$

From the expression (10), the RCL components of the equivalent circuit can be determined in the following manner:

$$C=P_4/(P_5V) \quad (11)$$

$$L_{osc}=1/(C(P_22+P_32) \quad (12)$$

$$R_{osc}=2L_{osc}P_2 \quad (13)$$

$$R_{att}=V/P_4 \quad (14)$$

The C component in the expression (11) above represents the capacitance component of the equivalent circuit. This is information indicative of the capacitance of the solvent and is not influenced very much by the toner concentration value. Further, $R_{att}$ in the expression (14) is information representative of the conductivity of the entire toner particles and ions. Consequently, by setting the following function expression based on the information given above, toner concentration information $F_1(\ )$ from which an influence of ions in the solvent is removed can be determined:

$$F_1(\ )=R_{att}C^K \quad (15)$$

where K is a coefficient which depends upon the temperature, the viscosity of the solvent used or the amount of charge of the toner.

Figure 5:
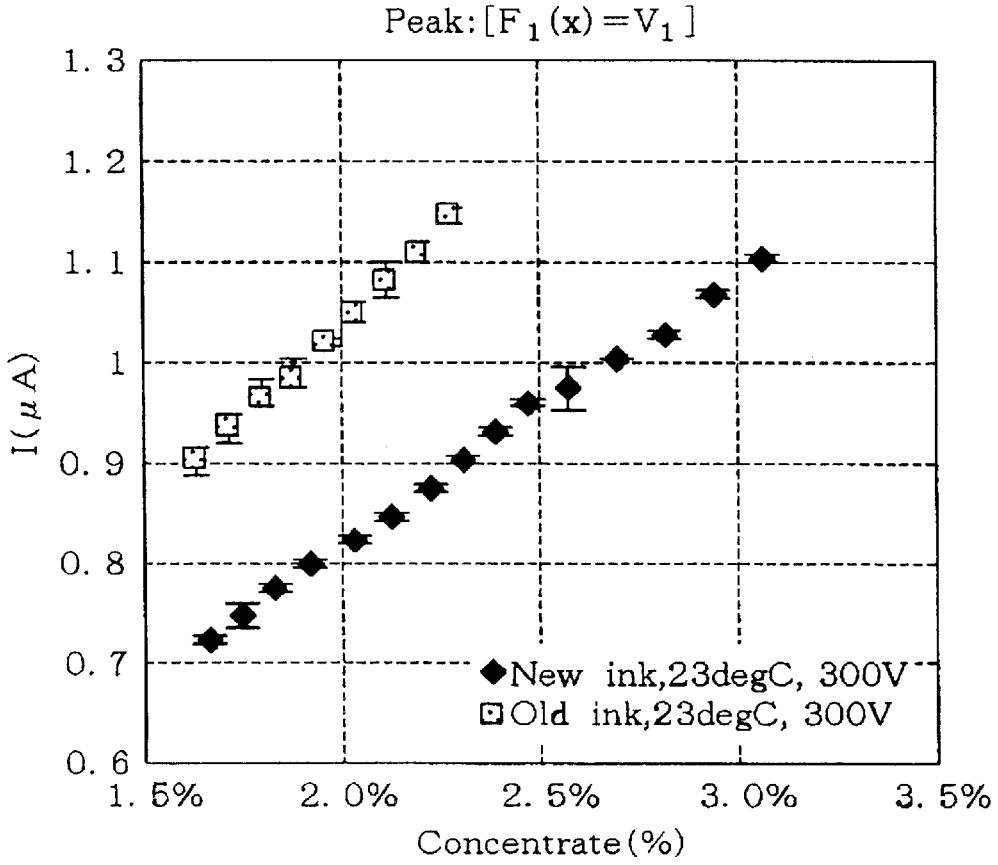
FIG. 5 is a diagram illustrating maximum current values (peak values) of current-time data obtained by measurement by the toner concentration measuring apparatus of FIG. 1 in regard to the peak value-concentration value for different inks having different concentrations.

In the following, an example is described. Measurement and calculation were performed for four different solvents having different ion amounts from one another using the electrode pair structure described above. It was proved that, with the information of a peak value simply indicative of the maximum value of a waveform, a correlation is found between the concentration and the measured and calculated value only in the same solvent, but no correlation between them is found between the solvents having different ion amounts as seen from FIG. 5. FIG. 5 is a graph indicating maximum current values (peak values) of current-time data obtained by the measurement in regard to the peak value-concentration value for the inks having different concentrations. It can be seen that even the same ink of the same concentration exhibits different peak values before and after it is used.

Figure 6:
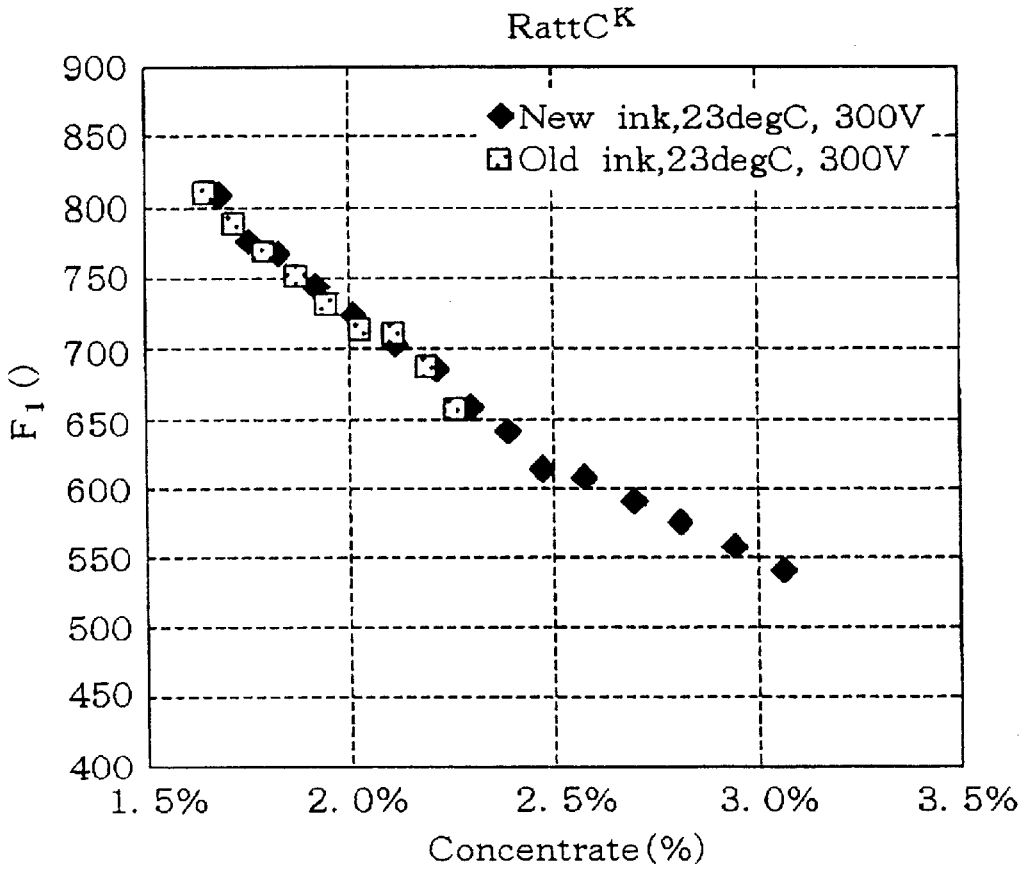
FIG. 6 is a diagram illustrating $F_1(\ )$ values of current-time data obtained by a measurement by the toner concentration measuring apparatus of FIG. 1 in regard to the $F_1(\ )$ value-concentration value for different inks having different concentrations.

On the other hand, all values obtained by the measurement and calculation based on the expression (15) which is a function expression of $R_{att}$ and C of the modeled equivalent circuit represent concentration information accurately as seen from FIG. 6 irrespective of a variation of the ion amount. FIG. 6 is a graph indicating $F_1(\ )$ values of current-time data obtained by the measurement in regard to the $F_1(\ )$ value-concentration value for the individual inks of different concentrations. Different from FIG. 5, it can be seen from FIG. 6 that the same ink of the same concentration exhibits an equal $F_1(\ )$ value before and after the ink is used.

In the toner concentration measuring apparatus of the present embodiment, the parameters in the expressions are determined so that the measured current waveform may be approximated to that provided by the expression (10). To this end, a non-linear optimization technique is required. Where a non-linear optimization technique is used, a high load is applied to an arithmetic section in the apparatus, and in the worst case, calculation diverges and this disables searching out of an optimum value. Thus, attention is paid to the function expression (15), and this expression is compared with the expression (10). From the comparison, it can be found that only the second term of the expression (10), that is, only the value of the attenuation term, is used as the parameter in the expression. Thus, if it is assumed that, at a time when oscillations of the measured waveform are reduced sufficiently, the second term on the right side of the expression (10) is almost equal to zero, then the expression (10) can be represented as $$I\approx P_4exp(-P_5t).$$

Since this expression is a function expression of the variable value I and t, it can be determined in accordance with the following simultaneous expressions (16) if data ($t_1$, $I_1$) and ($t_2$, $I_2$) at two measurement points when sufficient time passes from the time of the current-time data obtained by the measurement and oscillations are reduced sufficiently:

$$I_1=P_4exp(-P_5t_1)$$

$$I_2=P_4exp(-P_5t_2) \quad (16)$$

By solving the same, $$F_1(\ )=R_{att}C^K=(V/P_4)(P_4/(P_5V))^K=(I_1/exp(-\lambda t_1))^{K-1}\lambda^{-K}V^{1-K} \quad (17)$$

where $$\lambda=(\log_e(I_1/I_2))/(I_2-I_1).$$

From this, an $F_1(\ )$ value can be determined using the function expression from measurement values of two points without using a complicated optimization technique which is based on measurement a waveform. The $F_1(\ )$ value is not influenced by the ion amount in the solvent, and concentration values can be detected accurately and values corresponding in a one by one corresponding relationship to the concentration values are outputted. The output values are peculiar values depending upon the solvent, the type of the toner, the air temperature and the configuration of the circuit for measurement. Consequently, the correspondence between the concentration values and the $F_1(\ )$ values is converted into a table by evaluation in advance so that an $F_1(\ )$ value obtained by measurement with an actual apparatus can be converted directly into a concentration value by comparing the $F_1(\ )$ value with the data of the table prepared in the apparatus.

While a preferred embodiment of the present invention has been described using specific terms, such description is for illustrative purposes only, and it is to be understood that changes and variations may be made without departing from the spirit or scope of the following claims.

What is claimed is:

1. A toner concentration measuring method for measuring the concentration of toner in solvent, comprising the steps of:

applying a stepped dc voltage between a pair of electrodes in the solvent;

measuring very weak current flowing in a circuit formed from said pair of electrodes;

calculating, with the solvent between said pair of electrodes replaced into an equivalent circuit, a capacitance of the equivalent circuit in accordance with a circuit equation to determine an amount of ions in the solvent; and determining a toner concentration, from which an influence of a variation of the amount of ions in the solvent is eliminated, in accordance with a function expression in which the amount of ions and an impedance of the equivalent circuit are included as parameters.

2. A toner concentration measuring apparatus for measuring the concentration of toner in solvent, comprising:

a pair of electrodes placed in an solvent;

voltage application means for applying a stepped dc voltage between said pair of electrodes;

current measurement means for measuring very weak current flowing in a circuit formed between said pair of electrodes;

ion amount calculation means for calculating, with the solvent between said pair of electrodes replaced into an equivalent circuit, a capacitance of the equivalent circuit in accordance with a circuit equation to determine the amount of ions in the solvent; and concentration calculation means for determining a toner concentration, from which an influence of a variation of the amount of ions in the solvent is eliminated, in accordance with a function expression in which the amount of ions and an impedance of the equivalent circuit are included as parameters.

3. A toner concentration measuring apparatus as claimed in claim 2, wherein said pair of electrodes are cylindrical electrodes extending in parallel to each other such that circumferential faces thereof are opposed to and located near to each other, and are rotated by power from a source external to the time measuring apparatus so that, when rotated, the circumferential surfaces thereof are cleaned by a cleaning member secured in said apparatus.

4. A toner concentration measuring apparatus as claimed in claim 2, wherein it is assumed that an output current $I_{total}$ measured when the stepped dc voltage is applied to the solvent is composed of an output $I_{toner}$ originating from particles of the toner which have masses and originating from back plating of the particles of the toner and another output $I_{ion}$ originating from ions having little masses and originating from back plating of positive and negative ions such that an expression $I_{total}=I_{toner}+I_{ion}$ may be satisfied; the output value $I_{ion}$ which originates from the positive and negative ions is assumed as an output of an $R_1C_1$ circuit of a resistance $R_1$ and a capacitance $C_1$ and represented by an attenuation function $I_{ion}=(V/R_1)\exp(-t/C_1R_1))$ where V is a voltage and t is time; also the output $I_{toner}$ originating from the toner is assumed as an output of an $R_2C_2$ circuit of a resistance $R_2$ and a capacitance $C_2$ while oscillations of the output which are caused by the inertia of toner particles are considered to be a behavior of a second-order lag system, and the output $I_{toner}$ originating the toner is modeled with an $R_3C_3L_3$ circuit of a resistance $R_3$, a capacitance $C_3$ and an inductance $L_3$ to calculate the output $I_{toner}$ originating from the toner as a sum of an attenuation function $I_{att}$ and an attenuation oscillation function $I_{osc}$ in accordance with $$I_{toner}=I_{att}+I_{osc}$$

$$I_{toner-att}=(V/R_2)exp(-t/(C_2R_2))$$

$$I_{toner-osc}=((\alpha^2+\omega^2)/\omega)C_3exp(-\alpha t)\cos(\omega t)$$

where $$\alpha=R_3/(2L_3),\ \omega=(1/(L_3C_3)-\alpha^2)^{1/2}$$

then, the output current value $I_{total}$ flowing in the equivalent circuit is represented by $$I_{total}=I_{ion}+I_{toner-att}+I_{toner-osc}=(V/R_1)exp(-t/C_1R_1))+(V/R_2)exp(-t/(C_2R_2))+((\alpha^2+\omega^2)/\omega)C_3exp(-\alpha t)\cos(\omega t)$$

and then, the output current value $I_{total}$ is regarded as output current of the equivalent circuit composed of the $R_1C_1$ series circuit, the $R_2C_2$ series circuit and the $R_3C_3L_3$ series circuit connected in parallel.

5. A toner concentration measuring apparatus as claimed in claim 4, wherein it is assumed that the capacitance component is uniform for simplified consideration of the equivalent circuit and consequently only one capacitance component is involved as represented by $C_1 \equiv C_2 \equiv C_3 \equiv C$, and the resistances $R_1$ and $R_2$ are composed and other variables are re-arranged to place $$R_{att}=1/(1/R_1+1/R_2)$$

$$I_{att}=I_{ion}+I_{toner-att}$$

$$R_{osc}=R_3$$

$$I_{osc}=I_{toner-osc}$$

$$L_{osc}=L_3$$

and then, the composed circuit is determined as another equivalent circuit including an $R_{oscosc}$ series circuit and the resistance $R_{att}$ are connected in parallel.

6. A toner concentration measuring apparatus as claimed in claim 5, wherein a current amount $I_{total}$ which flows through the circuit when a switch of the equivalent circuit is closed is represented by $$I_{total}=((\alpha^2+\omega^2)\omega)CV\exp(-\alpha t)\cos(\omega t)+(V/R_{att})\exp(-t/CR_{att})$$

where $\alpha=R_{osc}/(2L_{osc})$ and $\omega=(1/(L_{osc}C)-\alpha^2)^{1/2}$, and a behavior I of toner particles and ions in the solvent is defined as represented by $$I=P_1(-P_2t)\cos(P_3t)+P_4\exp(-P_5t)$$

where $$P_1=1/(L_{osc}/C-(R_{osc}2)^2)^{1/2}$$

$$P_2=(R_{osc}/(2L_{osc}))$$

$$P_3=(1/(L_{osc}C)+R_{osc}/(2L_{osc}))^2)^{1/2}$$

$$P_4=V/R_{osc}$$

$$P_5=1/(R_{att}C)$$

and, from the expression above, the components of the equivalent circuit is determined as $$C=P_4/(P_5V)$$

$$L_{osc}=1/(C(P_22+P_32)$$

$$R_{osc}=2L_{osc}P_2$$

$$R_{att}=V/P_4$$

and then, toner concentration information $F_1(\ )$ is determined in accordance with a function expression represented by $F_1(\ )=R_{att}C^K$, where K is a coefficient which depends upon a temperature, a viscosity of the solvent used or an amount of charge of the toner.

7. An image forming apparatus comprising a toner concentration measuring apparatus as set forth in claim 2.

* * * * *